United States Patent [19]

McBeth

[11] 4,083,601

[45] Apr. 11, 1978

[54] FOUL WEATHER OUTDOOR CHAIR

[75] Inventor: John L. McBeth, Pueblo, Colo.

[73] Assignee: The Raymond Lee Organization, Inc., New York, N.Y. ; a part interest

[21] Appl. No.: 768,865

[22] Filed: Feb. 9, 1977

[51] Int. Cl.[2] ..... A47C 7/62

[52] U.S. Cl. ..... 297/184; 135/5 R

[58] Field of Search ..... 297/184; 403/290; 135/5

[56] References Cited

U.S. PATENT DOCUMENTS

| | | | |
|---|---|---|---|
| 1,258,045 | 3/1918 | Premysl | 297/184 |
| 2,137,427 | 11/1938 | Thomson | 297/184 X |
| 2,561,886 | 7/1951 | Rikelman | 297/184 X |
| 2,658,562 | 11/1953 | Androsiglio | 297/184 |
| 2,717,162 | 9/1955 | Walters | 403/290 X |
| 2,811,977 | 11/1957 | McClish | 297/184 X |

*Primary Examiner*—Francis K. Zugel

*Attorney, Agent, or Firm*—Daniel Jay Tick

[57] ABSTRACT

A pair of support members are pivotally affixed to corresponding frames of a folding chair and are positionable adjacent the corresponding frames in rest position and upright in operative position. Each of a pair of arms is releasably affixed to a corresponding one of the support members and extends upright. Back, top and side panels of wind and rain resistant material are affixable to the arms, the frames and each other for covering the top, back and sides of the chair and protecting an occupant thereof from wind and moisture.

2 Claims, 3 Drawing Figures

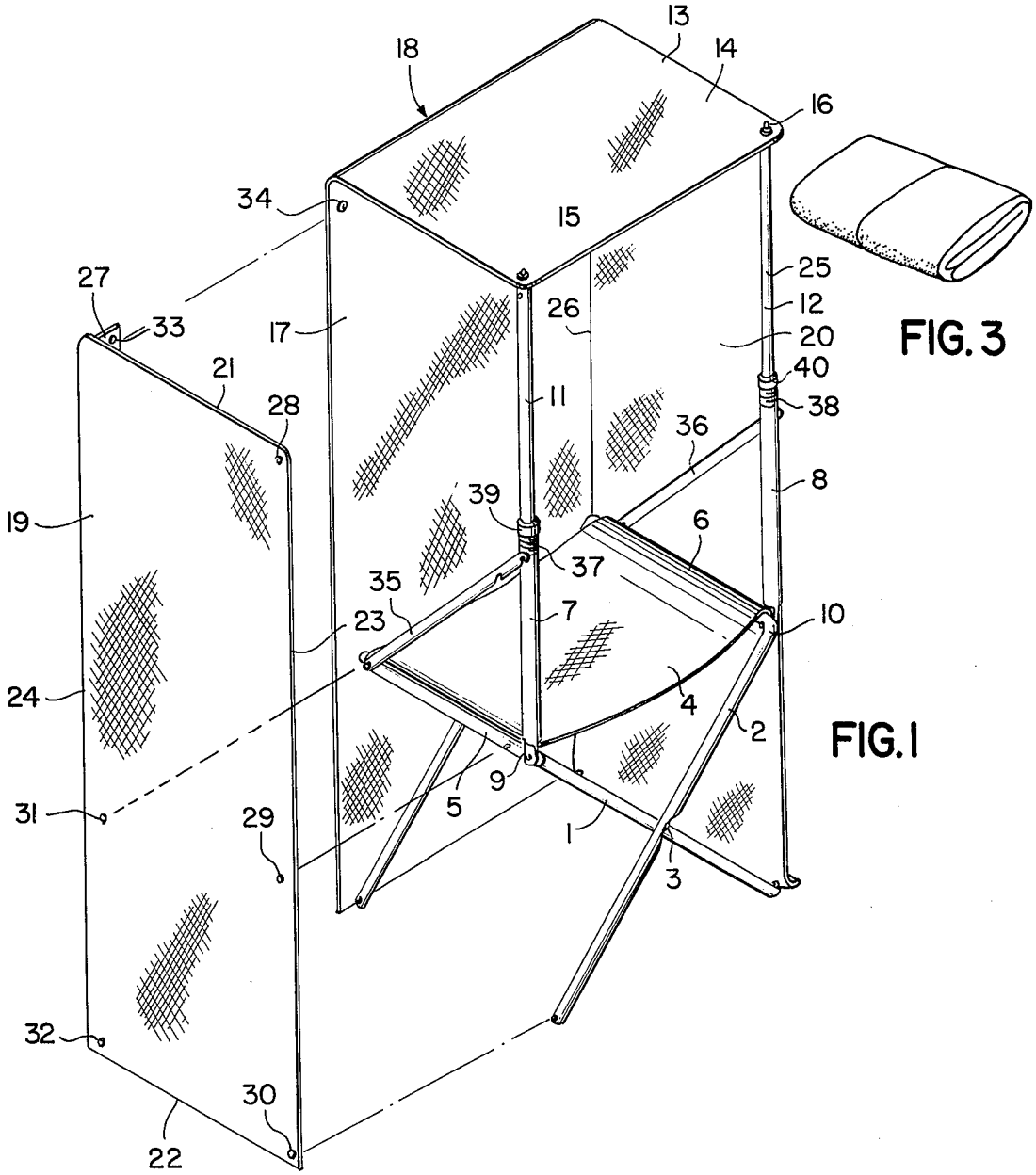
FIG. 3
FIG. 1
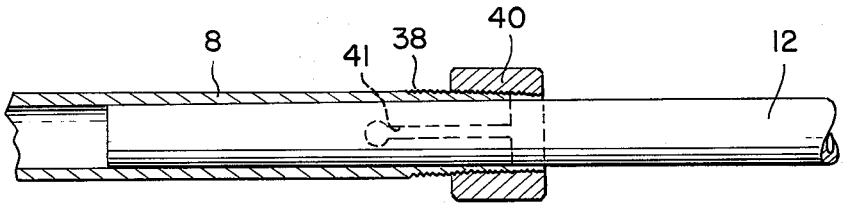
FIG. 2

FOUL WEATHER OUTDOOR CHAIR

BACKGROUND OF THE INVENTION

The present invention relates to a foul weather outdoor chair.

Objects of the invention are to provide a foul weather outdoor chair of simple structure, which is inexpensive in manufacture, folded and disassembled into a small compact, readily transportable package with facility, convenience and rapidity, unfolded and assembled to a usable position with facility, convenience and rapidity, and functions efficiently, effectively and reliably to provide shelter for an occupant of the chair from wind, rain, snow, sleet, hail and other foul weather thereby permitting such occupant to enjoy a sport such as, for example, ice fishing, with relative comfort.

BRIEF DESCRIPTION OF THE DRAWINGS

In order that the invention may be readily carried into effect, it will now be described with reference to the accompanying drawings, wherein:

FIG. 1 is a perspective view, partially exploded, of an embodiment of the foul weather outdoor chair of the invention in usable position;

FIG. 2 is a view, on an enlarged scale, partly in section, illustrating a preferred coupling device for coupling the arms to the support members of the chair of the invention; and FIG. 3 is a perspective view of the chair of FIG. 1 in folded, disassembled, collapsed or transportable condition.

DETAILED DESCRIPTION OF THE INVENTION

As shown in FIG. 1, the foul weather outdoor chair of the invention comprises a folding chair having a pair of square U frames 1 and 2 pivotally affixed to each other via a pivot rivet 3 and another pivot rivet (not shown in the FIGS.). A seat sheet 4 of material has spaced opposite edges 5 and 6 affixed to the frames 1 and 2, respectively.

As shown in FIG. 1, a pair of support members 7 and 8 are pivotally affixed to the frames 1 and 2, respectively, at a front top corner 9 and 10, respectively, thereof. The support members 7 and 8 are positionable adjacent the frames 1 and 2 in rest position and are substantially upright in operative position, as shown in FIG. 1.

As shown in FIG. 1, a pair of arms 11 and 12 are releasably affixed to the support members 7 and 8, respectively, and extend substantially upright from said support members.

As shown in FIG. 1, a back and top panel 13 of wind and rain resistant material of inverted L shape has a top part 14 removably affixable to the tops of the arms 11 and 12 via bolts 15 and 16 passing through bores formed through corresponding corners thereof. The top part 14 covers the top of the chair. The back and top panel 13 has a back part 17 extending substantially perpendicularly from the back edge 18 of the top part 14 for covering the back of the chair to the ground.

As shown in FIG. 1, a pair of side panels 19 and 20 of wind and rain resistant material are of rectangular configuration. The back and top panel 13 and the side panels 19 and 20 may comprise any suitable wind and rain or moisture resistant material such as, for example, plastic material. The side panel 19 has a spaced opposite top and bottom 21 and 22 and a pair of spaced side edges 23 and 24. The side panel 20 has a spaced opposite top and bottom (not shown in the FIGS.) and a pair of spaced side edges 25 and 26. Each of the side panels 19 and 20 is removably affixable to the back part 17 of the back and top panel 13 via a flange extending along its back edges 24 and 26, respectively. The flange 27 of the side panel 19 is shown in FIG. 1. The side panels 19 and 20 are removably affixable to the frames 1 and 2, respectively, of the chair for covering the sides of the chair from the top part 14 of the back and top panel 13 to the ground and from the back part 17 of said back and top panel to the front of the chair. This is accomplished by a plurality of bores such as, for example, bores 28, 29 and 30 along the front edge of the side panel 19 for affixing said panel to the frame 1 and the frame 2 via bolts passing therethrough into said frames, and bores 31 and 32 formed through said side panel along the back edge thereof for affixing said panel to the frames 1 and 2 via bolts passing therethrough. The side panel 19 is affixed to the back and top panel 13 via the flange 27 of said side panel, and, more particularly, via a bore 33 through said flange and a bore 34 through the back part 17 of said back and top panel and an appropriate bolt. The side panel 20 is affixed to the chair in the same manner as is the side panel 19.

A pair of reinforcing members or struts 35 and 36 are pivotally affixed to the frames 1 and 2, respectively, as shown in FIG. 1. The reinforcing members 35 and 36 are pivotally affixed to the frames 1 and 2, respectively, at one end of said members and are latched to the support members 7 and 8, respectively, at the other end of said reinforcing members. This functions to strengthen the chair and the positions of the support members 7 and 8.

The support members 7 and 8 are tubular, as are the frames 1 and 2. The tops 37 and 38 of the support members 7 and 8, respectively, are tapered and externally threaded, as shown in FIGS. 1 and 2. The bottoms of the arms 11 and 12 are coaxially positionable in the tops of the support members 7 and 8, respectively. A pair of nuts 39 and 40 with tapered internal threading, as shown in FIG. 2, are threadedly coupleable to the support members 7 and 8, respectively, to tighten the arms 11 and 12, respectively, positioned therein. The bottoms of the arms 11 and 12 are preferably split longitudinally along a slot 41, as shown in FIG. 2 for the arm 12, in order to provide a greater clamping action for securing said arms in the support members.

While the invention has been described by means of a specific example and in a specific embodiment, I do not wish to be limited thereto, for obvious modifications will occur to those skilled in the art without departing from the spirit and scope of the invention.

I claim:

1. A foul weather outdoor chair, comprising a folding chair having a pair of square U frames pivotally affixed to each other and a seat sheet of material having spaced opposite edges each affixed to a corresponding one of the frames;

a pair of support members each pivotally affixed to a corresponding one of the frames at a front top corner thereof and positionable adjacent the corresponding frame in rest position and substantially upright in operative position;

a pair of arms each releasably affixed to a corresponding one of the support members and extending substantially upright;

a back and top panel of wind and rain resistant material of inverted L-shape with a top part removably affixable to the tops of the arms for covering the top of the chair and a back part extending substantially perpendicularly from the back edge of the top part for covering the back of the chair to the ground; and a pair of rigid side panels of wind and rain resistant material of rectangular configuration each having a spaced opposite top and bottom and a pair of spaced side edges, each of the side panels being removably affixable to the back part of the back and top panel and to the frames of the chair for covering the sides of the chair from the top part of the back and top panel to the ground and from the back part of the back and top panel to the front of the chair.

2. A foul weather outdoor chair as claimed in claim 1, wherein the support members are tubular, the tops of the support members are tapered and externally threaded and the bottoms of the arms are coaxially positionable in the tops of the support members, and further comprising a pair of nuts with tapered internal threading each threadedly coupleable to a corresponding one of the support members to tighten an arm positioned therein.

* * * * *